US008353791B2

(12) United States Patent
Holthouse et al.

(10) Patent No.: US 8,353,791 B2
(45) Date of Patent: Jan. 15, 2013

(54) TRACKING BALLS IN SPORTS

(75) Inventors: Shaun Holthouse, Scoresby (AU); Igor van de Griendt, Scoresby (AU)

(73) Assignee: Catapult Innovations Pty Ltd, Scoresby (AU)

( * ) Notice: Subject to any disclaimer, the term of this patent is extended or adjusted under 35 U.S.C. 154(b) by 932 days.

(21) Appl. No.: 12/191,460

(22) Filed: Aug. 14, 2008

(65) Prior Publication Data

US 2009/0048039 A1 Feb. 19, 2009

(30) Foreign Application Priority Data

Aug. 15, 2007 (AU) ..... 2007904361

(51) Int. Cl.
*A63F 9/24* (2006.01)
*A63F 13/00* (2006.01)

(52) U.S. Cl. ..... 473/415; 463/7; 463/40; 340/686.6; 342/118; 342/385; 342/386; 342/411; 342/450

(58) Field of Classification Search ..... 342/118, 342/385, 386, 411, 450, 458, 464, 470; 340/686.6; 473/415
See application file for complete search history.

(56) References Cited

U.S. PATENT DOCUMENTS

| | | | | |
|---|---|---|---|---|
| 4,762,005 A | | 8/1988 | Marshek et al. | |
| 4,824,107 A | | 4/1989 | French | |
| 5,099,702 A | | 3/1992 | French | |
| 5,336,959 A | | 8/1994 | Park et al. | |
| 5,346,210 A | | 9/1994 | Utke et al. | |
| 5,471,405 A | * | 11/1995 | Marsh | 702/41 |
| 5,513,854 A | * | 5/1996 | Daver | 700/91 |
| 5,583,776 A | * | 12/1996 | Levi et al. | 701/217 |
| 5,598,849 A | * | 2/1997 | Browne | 600/520 |
| 5,724,265 A | * | 3/1998 | Hutchings | 702/141 |
| 5,825,327 A | * | 10/1998 | Krasner | 342/357.57 |
| 5,976,038 A | | 11/1999 | Orenstein et al. | |
| 6,011,468 A | * | 1/2000 | Lee | 340/545.1 |
| 6,013,007 A | * | 1/2000 | Root et al. | 482/8 |
| 6,117,031 A | | 9/2000 | Malinauskas et al. | |
| 6,265,974 B1 | * | 7/2001 | D'Angelo et al. | 340/568.1 |
| 6,357,147 B1 | * | 3/2002 | Darley et al. | 36/136 |
| 6,536,139 B2 | * | 3/2003 | Darley et al. | 36/136 |

(Continued)

FOREIGN PATENT DOCUMENTS

AU 2006222732 10/2006

(Continued)

*Primary Examiner* — Steven J Hylinski
(74) *Attorney, Agent, or Firm* — Connolly Bove Lodge & Hutz LLP

(57) ABSTRACT

A system for tracking balls in sports in which players kick, pass, bounce, strike or carry a ball. The ball is equipped with two beacons pulsing in the 5-10 Hz range at a frequency which is not attenuated by the body of the players. one beacon has a very short range of 40-120 cm and the other has a range of 1-5 meters. A data logger worn by the players includes a clock, location and speed sensors, a receiver for the beacon signals and a micro controller to record the data from all the sensors. The micro controller is able to record whether the player is in possession of the ball or is contesting the ball. The path of the ball from player to player is tracked relative to the playing field. An impact or pressure sensor may be fitted to the players footwear, glove or a bat stick, club or racquet to register a kick or ball strike.

4 Claims, 3 Drawing Sheets

U.S. PATENT DOCUMENTS

| | | | | |
|---|---|---|---|---|
| 6,749,432 | B2 * | 6/2004 | French et al. | 434/247 |
| 6,876,947 | B1 * | 4/2005 | Darley et al. | 702/160 |
| 7,015,824 | B2 * | 3/2006 | Cleveland et al. | 340/686.1 |
| 7,091,863 | B2 | 8/2006 | Ravet | |
| 7,292,867 | B2 * | 11/2007 | Werner et al. | 455/456.3 |
| 7,404,263 | B2 * | 7/2008 | Guzman | 36/133 |
| 7,559,127 | B2 * | 7/2009 | Rooney et al. | 24/712 |
| 7,607,243 | B2 * | 10/2009 | Berner et al. | 36/136 |
| 7,620,466 | B2 * | 11/2009 | Neale et al. | 700/91 |
| 7,698,101 | B2 * | 4/2010 | Alten et al. | 702/182 |
| 7,911,324 | B2 * | 3/2011 | Breed et al. | 340/10.1 |
| 2002/0116147 | A1 * | 8/2002 | Vock et al. | 702/182 |
| 2002/0138163 | A1 * | 9/2002 | MacPherson | 700/92 |
| 2002/0143790 | A1 * | 10/2002 | Qian | 707/104.1 |
| 2005/0162257 | A1 * | 7/2005 | Gonzalez | 340/323 R |
| 2005/0227811 | A1 * | 10/2005 | Shum et al. | 482/1 |
| 2005/0259002 | A1 * | 11/2005 | Erario et al. | 342/357.07 |
| 2006/0136173 | A1 * | 6/2006 | Case et al. | 702/182 |
| 2006/0148594 | A1 * | 7/2006 | Saintoyant et al. | 473/405 |
| 2006/0178235 | A1 * | 8/2006 | Coughlan et al. | 473/438 |
| 2007/0006489 | A1 * | 1/2007 | Case et al. | 36/132 |
| 2007/0011919 | A1 * | 1/2007 | Case | 36/132 |
| 2007/0021269 | A1 * | 1/2007 | Shum | 482/8 |
| 2007/0060425 | A1 * | 3/2007 | Kuenzler et al. | 473/570 |
| 2007/0135243 | A1 * | 6/2007 | LaRue et al. | 473/467 |
| 2007/0247306 | A1 * | 10/2007 | Case | 340/539.11 |
| 2007/0260421 | A1 * | 11/2007 | Berner et al. | 702/160 |
| 2007/0287596 | A1 * | 12/2007 | Case et al. | 482/8 |
| 2008/0079603 | A1 * | 4/2008 | King et al. | 340/825.69 |
| 2008/0088303 | A1 * | 4/2008 | Englert | 324/226 |
| 2008/0125288 | A1 * | 5/2008 | Case | 482/1 |

FOREIGN PATENT DOCUMENTS

| | | |
|---|---|---|
| WO | WO-9910052 | 3/1999 |

* cited by examiner

TRACKING BALLS IN SPORTS

CROSS REFERENCE TO RELATED APPLICATIONS

This application claims priority under 35 U.S.C. §119(a) on Patent Application No. 2007904361 filed in Australia on Aug. 15, 2007, the entire contents of which are hereby incorporated by reference.

This invention relates to a system and method of tracking balls, possession and actions in sports particularly the various codes of football using oval balls and the various team sports using round balls such as soccer basket ball and netball.

BACKGROUND TO THE INVENTION

The idea of locating beacons in balls has been proposed.

U.S. Pat. No. 6,117,031 discloses a ball with a sound emitter for the visually impaired.

U.S. Pat. No. 5,346,210 discloses a hockey puck with a transmitter which is turned on when the puck is struck using a shock sensor and turned off using a timer.

U.S. Pat. No. 5,976,038 discloses a foot ball with a transmitter at each end transmitting different frequencies. These are detected by antennas off the field of play to detect line crossing as in out of bounds or a score.

U.S. Pat. No. 7,091,863 discloses a football with a readable sensor which can be read by readers located on the periphery of a playing field. The readers communicate with a computer so that the ball can be tracked as it moves over the field. The sensor in the ball may be a transmitter or transceiver and includes GPS, radio frequency tag, infra red or laser transmitter.

These systems are expensive as they rely on powerful transmitters and receivers that need to be located around the playing field. They also use expensive electronic equipment within the balls. Sport balls usually experience rapid wear and tear during a game and need to be replaced often.

U.S. Pat. Nos. 4,762,005 and 4,824,107 disclose a piezo based transducer arrangement to be incorporated into the gloves, headgear or body suit of the participants in martial arts. Wireless transmission of the piezo signals sends the data to a computer for analysis and display. The devices simply measure the number of impacts.

U.S. Pat. No. 5,099,702 discloses a force pad also for recording impacts.

U.S. Pat. No. 5,336,959 uses a piezo film to locate the point of impact of a ball.

WO 99/10052 discloses a boxing training system with sensors on gloves or a punching bag to record the number of hits.

It is an object of this invention to provide an inexpensive means of locating the travel path of a ball and also detect possessions and the methods by which it is propelled.

BRIEF DESCRIPTION OF THE INVENTION

To this end the present invention provides a ball which incorporates at least one short range wireless beacon or radio frequency identification device.

In a further aspect the invention provides a system for tracking balls in a team sport in which players kick, pass, bounce or carry a ball which includes a) a ball equipped with a short range wireless beacon emitting periodic signals or a passive or active radio frequency identification device b) a data logger worn by the players which includes a clock, a receiver for the signals from the beacon or radio frequency identification device and a micro controller to record the data from all the sensors wherein the micro controller is able to record whether the player is in possession of the ball or is contesting the ball.

Preferably the data logger worn by the players also includes location and speed sensors, which enable the micro controller to track the path of the ball from player to player relative to the playing field. A suitable data logger is disclosed in Australian patent 2006222732 which discloses a data logger that can track the movement of a player on a playing field.

Preferably the signals are transmitted at a frequency which is not attenuated by the body of the players. Preferably a wireless beacon pulsing in the 5-10 Hz range may be used. Preferably two beacons are used one with a very short range of 40-120 cm and the other with a range of 1-5 meters. These signals are picked up by a data logger worn by the players and used to indicate that the player is either in possession of the ball (short range beacon) or contesting possession(longer range beacon). Alternatively the beacons may generate magnetic fields detected by sensors worn by the players or incorporated in the data loggers.

Instead of tracking the ball directly this system tracks the ball relative to the players and records and tracks possession from player to player. Currently available technology such as GPS (or wireless triangulation ) provides the position of the players on the field and allows the player's movements during the game to be tracked. This invention adds information about which player is in proximity to the ball and has had impact with it (for instance a kick) and this enables a computer simulation of the path of the ball during play. This is an inexpensive alternative to the extremely cumbersome methods currently available for direct ball tracking.

The beacons may be powered by a battery or a piezo energy harvester mounted on the football cover which produces current from impacts to power the beacons. The occurrence of impacts can also be used to switch the beacons on and absence of impacts can turn it off.

To provide further information the system may provide a pressure pad integrated with a low power wireless transmitter located on the tongue of the football boot to transmit a signal when a ball is kicked. A kick results in a wireless pulse which is recorded on the data logger worn by the players.

In another aspect this invention provides a system for monitoring kicks in a team sport in which players kick a ball which includes a) a pressure or impact sensor in combination with a transmitter fitted on the upper of a players footwear b) a data logger worn by the players which includes a clock, a receiver for the signals from said transmitter and a micro controller to record the data from the pressure or impact sensor to record whether the player has kicked the ball.

Similarly the sensor could be fitted to a cricket or baseball bat, a hockey stick. A golf club or a racquet as used in tennis, or badminton.

In a further aspect this invention provides a system for monitoring ball strikes in a sport in which players strike a ball with a bat, stick, club or racquet which includes a) a pressure or impact sensor in combination with a transmitter fitted on the bat, stick or racquet or on the hand of the player b) a data logger worn by the players which includes a clock, a receiver for the signals from said transmitter and a micro controller to record the data from the pressure or impact sensor to record whether the player has struck the ball.

DETAILED DESCRIPTION OF THE INVENTION

A preferred embodiment of the invention will now be described with reference to the drawings in which.

Figure 1:
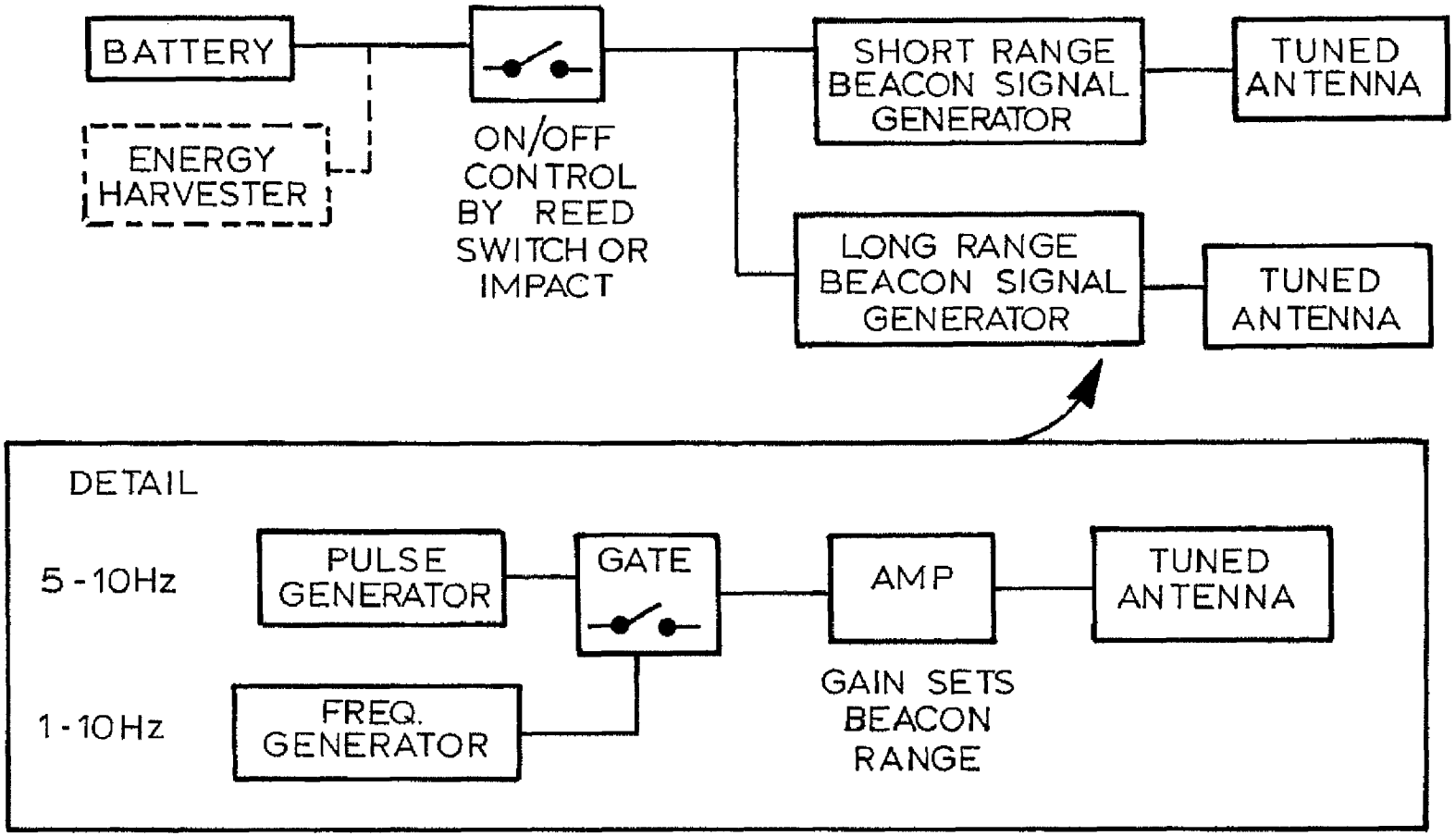
FIG. 1 is a schematic circuit diagram for the beacon used in a ball.

The system of this invention preferably includes 2 wireless beacons inside the ball, as shown in FIG. 1; one at 2.5 kHz and one at 4 kHz. Both beacons will pulse the wireless signal at 5-10 Hz. One will have a range of about 40-120 cm and the other a range of 1-5 meters. The beacons will be powered with a small lithium battery at 3V. As shown in FIG. 1 an energy harvester may be used instead of a battery. Corresponding pick up coils inside the data logger device, illustrated in FIG. 2, worn by the players, will listen for the beacons. A preferred data logger is of the type described in Australian patent application 2006222732.

Figure 4:
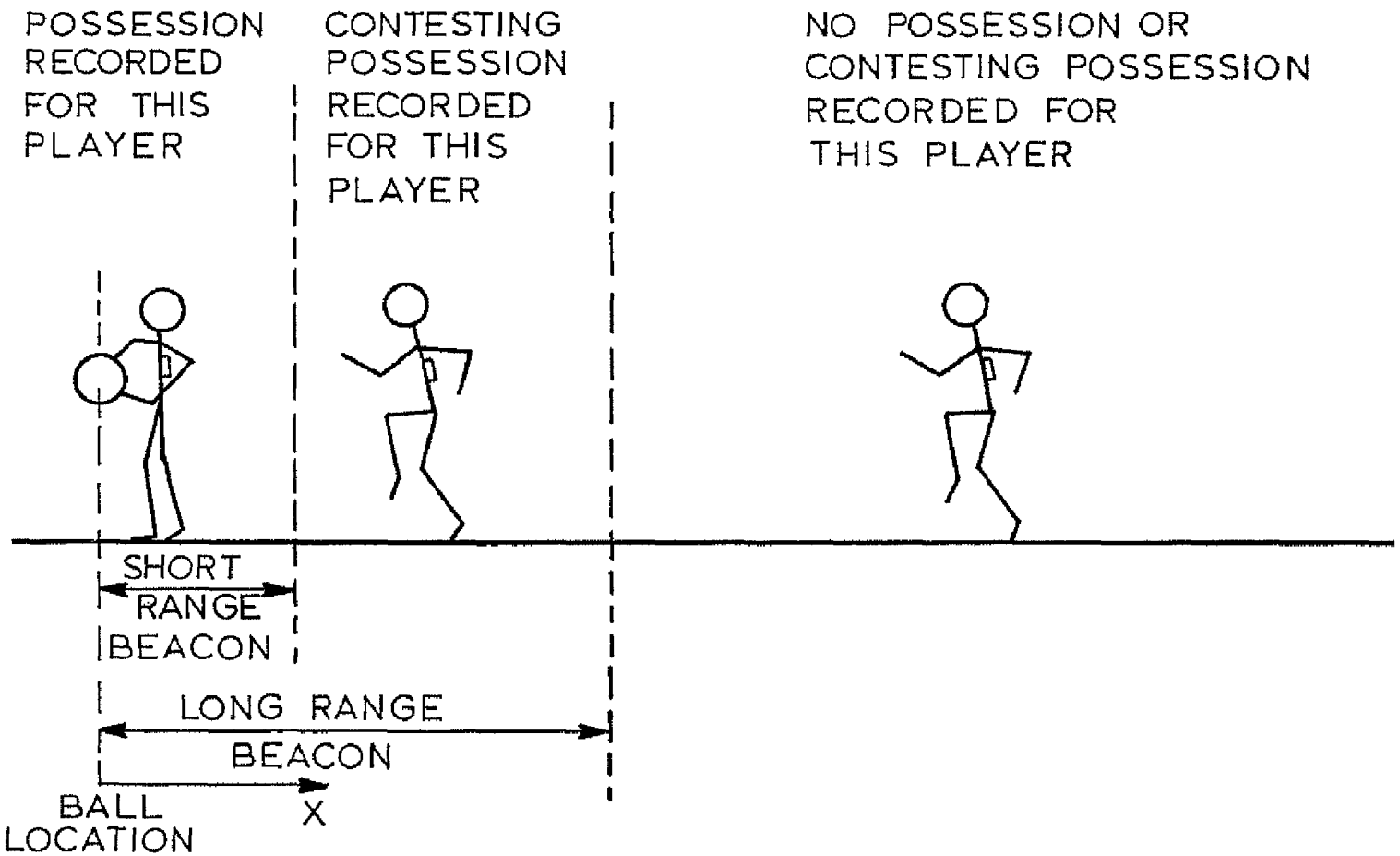
FIG. 4 is a schematic diagram of players contesting possession of a ball in accordance with this invention.

Since the data logger is worn on the athlete, a pickup of the short range beacon will indicate possession of the ball and a pick up of the longer range beacon will indicate proximity to the "play" (i.e. the athlete was involved in the play). As shown in FIG. 4 the data collected from the ball beacon can indicate if the player is in possession of the ball or contesting the ball or too far away to be directly involved in the contest for the ball. In combination with the other data streams from the data logger, it is then possible to track possessions, disposals, turnovers (when one team transfers the ball to the other team), and even information like number and time of bounces etc.

Since the electronics used in the ball are low powered, the battery will last longer than the ball. The electronics are also inexpensive so that the cost of the instrumented balls is only a small increment above normal ball cost. If desired a switch on/off functionality via a reed switch in the electronics may be provided. Passing a magnetic wand over one or more balls would switch them on or off.

In one embodiment the ball transmitter uses three timer circuits to produce an out put signal. Timer 1 enables the power for operation of the transmitter and may be set to a suitable interval such as 5 minutes. A trigger circuit based on a shock sensor activates the circuit once the ball is kicked off. The ball then transmits continuously for a maximum period of the selected interval (5 minutes). If the ball is kicked again the timer is reset and starts again. Power is only permanently provided to the trigger circuit. The receiver circuit on the data logger uses two sets of MFB filters used with 90 degrees oriented coils for maximum reception.

An alternative is to have a motion activated on switch. When the ball bounces or experiences impact, the wireless beacon turns on and runs for a set period (such as 5 minutes) at which time it turns off if there have been no further impacts. Another alternative is to power the ball via an energy harvester and super capacitor. For instance a peizo device between the skin and bladder of the ball could generate voltage and charge a super capacitor to provide power to the beacons.

The second aspect of this invention will be described in relation to Golf.

Figure 2:
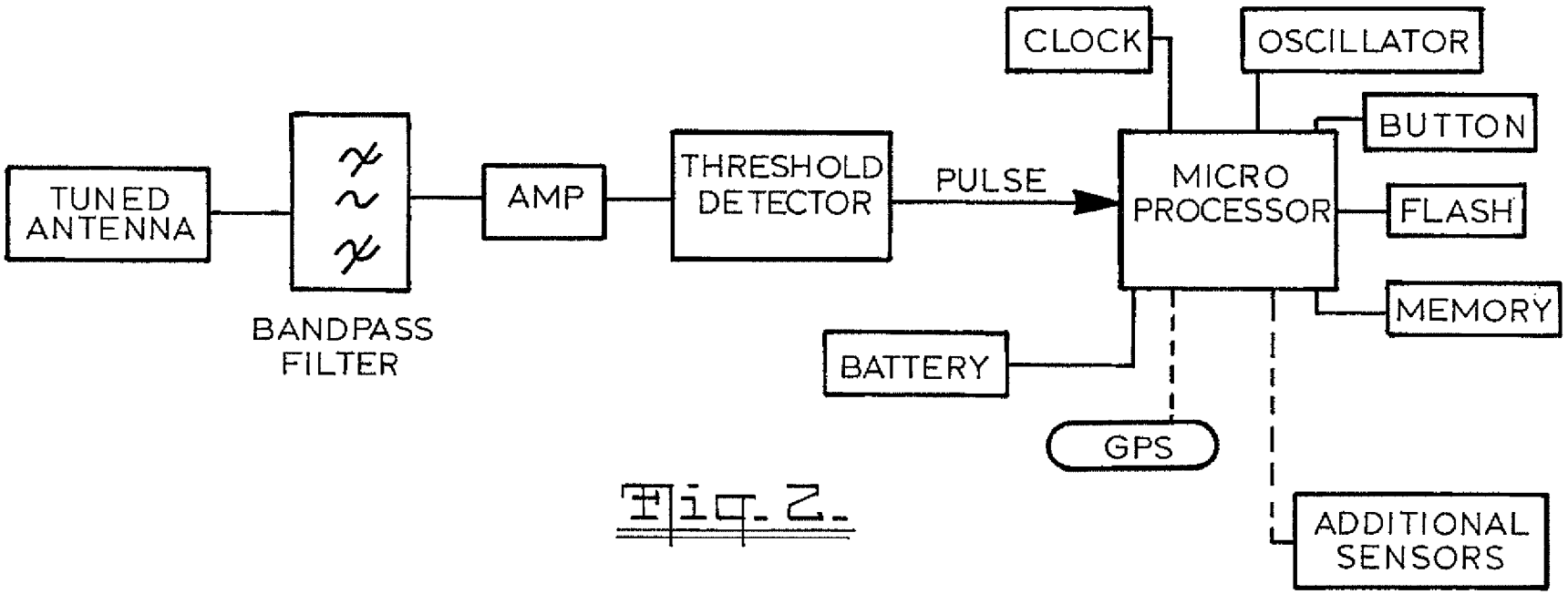
FIG. 2 is a schematic circuit diagram of the data logger used in this invention.
Figure 3:
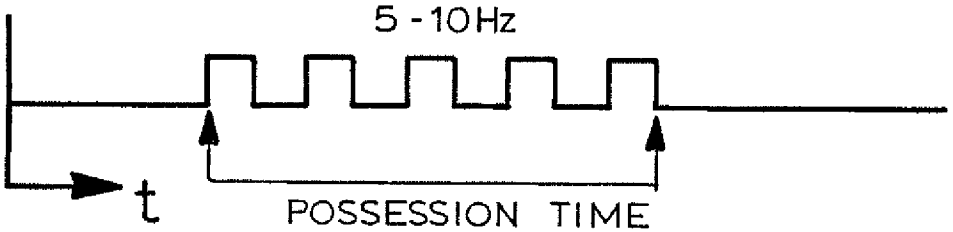
FIG. 3 is a schematic of the signals recorded on the data logger.

A golfer may wear a data logger as shown in FIG. 2 on his body and use a glove which is instrumented with the pressure/impact sensor and a low powered wireless transmitter. When the golfer hits the ball, the impact sensor registers a hit and sends a wireless pulse which can be read by the data logger.

In this way the golfers score can be computed (number of shots).

Also, using the GPS sensor in the data logger, the length of each shot and location can be recorded. It is possible to integrate the GPS data with a map of the golf course. A complete record of where the ball was hit around the course can be established.

Furthermore, using the additional sensors such as gyro and accelerometer sensors on the data logger, diagnostic information about the golf swing can be recorded for later analysis or entertainment.

For example, magnetometers in conjunction with the other sensors can tell which direction the golfer was facing as he swung the club and then, via GPS maps, whether that direction was appropriate for the shot.

Gyroscopes can tell how fast the club was swung during the stroke and whether this was appropriate for the shot.

The number of practice swings could be measured via the gyroscope.

The golfer can later integrate all this information via software to replay his session and analyse his performance.

Since golf gloves have a limited life, this invention provides a way for the associated electronics to be low cost (the more expensive sensors are located on the data logger). Putting the impact sensor on the glove avoids instrumenting multiple clubs or golf balls.

In the case where the golf ball has instrumentation in it (like the ball example above), the short and long range beacons can be used to alert the user that he is near the ball, and hence help him find a lost ball.

Those skilled in the art will realise that this invention provides a unique system that is able to be used in a range of sports to track the movement of the ball relative to one or more players. Those skilled in the art will also realise that this invention can be implemented in embodiments other than those described without departing from the core teachings of the invention.

The invention claimed is:

1. A system for tracking balls in a team sport in which players kick, pass, bounce or carry a ball, which system comprises:

a ball comprising at least one short range beacon emitting periodic signals; and a data logger worn by a player which comprises a clock, a receiver for signals from the beacon and a micro controller arranged to record receipt of signals, which receipt distinguishes between the player being in possession of the ball and the player contesting the ball, the data logger further comprising one or more location sensors for tracking movements of the player on a playing field, the micro controller being adapted to record data from all the sensors, wherein the one or more location sensors utilize GPS, accelerometers and/or wireless triangulation.

2. The system as claimed in claim 1, wherein the at least one short range beacon emitting periodic signals comprises a first pulsing short range beacon emitting periodic signals and a second pulsing beacon emitting periodic signals, wherein the first and second beacons use different frequencies, and wherein the first beacon has a range of 40-120 cm and the second beacon has a range of 1-5 meters so that receipt of signals from both beacons indicates possession of the ball and receipt of a signal from the second beacon indicates that the player is contesting possession of the ball.

3. The system as claimed in claim 1, which further comprises a pressure or impact sensor located on the upper of a players' footwear in combination with a transmitter that transmits a pulse when the ball is kicked.

4. The system as claimed in claim 2, which further comprises a pressure or impact sensor located on the upper of a players' footwear in combination with a transmitter that transmits a pulse when the ball is kicked.

* * * * *